US010458376B2

(12) United States Patent
Kimura et al.

(10) Patent No.: US 10,458,376 B2
(45) Date of Patent: Oct. 29, 2019

(54) AIR CLEANER FOR INTERNAL COMBUSTION ENGINE

(71) Applicant: TOYOTA BOSHOKU KABUSHIKI KAISHA, Aichi-ken (JP)

(72) Inventors: Ryusuke Kimura, Ichinomiya (JP); Yoshinori Inuzuka, Nishio (JP)

(73) Assignee: TOYOTA BOSHOKU KABUSHIKI KAISHA, Aichi-ken (JP)

( * ) Notice: Subject to any disclaimer, the term of this patent is extended or adjusted under 35 U.S.C. 154(b) by 46 days.

(21) Appl. No.: 15/491,316

(22) Filed: Apr. 19, 2017

(65) Prior Publication Data

US 2017/0321640 A1 Nov. 9, 2017

(30) Foreign Application Priority Data

May 9, 2016 (JP) ..... 2016-093929

(51) Int. Cl.
*F02M 35/14* (2006.01)
*F02M 35/02* (2006.01)
(Continued)

(52) U.S. Cl.
CPC ..... *F02M 35/14* (2013.01); *F02M 35/0201* (2013.01); *F02M 35/02425* (2013.01); *F02M 35/02491* (2013.01); *F02M 35/1272* (2013.01)

(58) Field of Classification Search
CPC ..... F02M 35/02; F02M 35/02458; F02M 35/0218; F02M 25/0854; F02M 35/1272;
(Continued)

(56) References Cited

U.S. PATENT DOCUMENTS 1,953,543 A * 4/1934 Rensink ..... F02M 35/14 181/229
3,174,682 A * 3/1965 Wilfert ..... B60H 1/00471 415/119
(Continued)

FOREIGN PATENT DOCUMENTS

CN 101392705 3/2009
JP S59-139573 U 9/1984
(Continued)

OTHER PUBLICATIONS

Chinese Office Action dated Dec. 25, 2018 in counterpart application No. 201710290842.9 (along with English-language translation).
(Continued)

*Primary Examiner* — Syed O Hasan
(74) *Attorney, Agent, or Firm* — Greenblum & Bernstein, P.L.C.

(57) ABSTRACT

An air cleaner for an internal combustion engine includes a first housing having an inlet and an upper opening, a second housing having an outlet and a lower opening, a filter element arranged between the upper opening of the first housing and the lower opening of the second housing. The first housing includes a sound reducing wall portion. The sound reducing wall portion has a sound absorbing layer, which is made of nonwoven fabric, and an inner covering layer, which is fixed to the inner surface of the sound absorbing layer and made of a material having a lower air permeability than that of the sound absorbing layer.

9 Claims, 5 Drawing Sheets

(51) Int. Cl.
*F02M 35/024* (2006.01)
*F02M 35/12* (2006.01)

(58) Field of Classification Search
CPC ..... F02M 35/14; F02M 35/0201; F02M 35/02425; F02M 35/02491; B01D 2259/4516; B01D 2253/102; B01D 46/0036
USPC ..... 123/198 E
See application file for complete search history.

(56) References Cited

U.S. PATENT DOCUMENTS 3,980,912 A * 9/1976 Panza ..... H02K 5/24 310/51
5,007,342 A * 4/1991 Abendroth ..... B41F 21/00 101/416.1
6,386,317 B1 * 5/2002 Morohoshi ..... F16L 55/033 181/224
7,621,372 B2 * 11/2009 Yamaura ..... F02M 35/02 123/184.21
2001/0013274 A1 * 8/2001 Oda ..... B01D 46/0005 96/134
2004/0118371 A1 * 6/2004 Kino ..... F02M 35/14 123/184.42
2013/0305930 A1 * 11/2013 Oh ..... B01D 46/0002 96/385
2013/0316102 A1 * 11/2013 Yoshida ..... B62D 29/04 428/34.5
2016/0222927 A1 8/2016 Kalauch

FOREIGN PATENT DOCUMENTS

JP 64-11359 1/1989
JP H08-152890 A 6/1996
JP 2000-110682 A 4/2000
JP 2002-21660 1/2002
JP 2007-321600 A 12/2007
WO WO2015049036 4/2015

OTHER PUBLICATIONS

Japanese Office Action in counterpart Japanese Application No. 2016-093929, dated Jul. 30, 2019 (with English-language translation).

* cited by examiner

AIR CLEANER FOR INTERNAL COMBUSTION ENGINE

BACKGROUND OF THE INVENTION

The present invention relates to an air cleaner for an internal combustion engine.

Conventionally, an air cleaner for a vehicle-mounted internal combustion engine has a first housing having an inlet and an opening, a second housing having an outlet and an opening, a filter element arranged between the opening of the first housing and the opening of the second housing.

The wall portion of the housing of the air cleaner described in Japanese Laid-Open Patent Publication No. 2002-21660 is formed by sound absorbing material composed of filter paper, nonwoven fabric, or porous material such as open-cell sponge. The inner wall surface of the housing of the air cleaner described in Japanese Laid-Open Utility Model Publication No. 64-11359 is constituted by a sound absorbing layer such as foamed polyurethane. In these air cleaner, the sound absorbing material reduces intake noise.

The present inventors discovered that, in an air cleaner, the sound pressure levels of components of a low frequency range of intake noise are greater than the sound pressure levels of components of a high frequency range, and that the low frequency components are the main cause of the noise. However, conventional air cleaners having the above described sound absorbing material or sound absorbing layer cannot readily reduce the low frequency components.

SUMMARY OF THE INVENTION

Accordingly, it is an objective of the present invention to provide an air cleaner for an internal combustion engine that effectively reduces components of a low frequency range of intake noise.

To achieve the foregoing objective and in accordance with one aspect of the present invention, an air cleaner for an internal combustion engine is provided. The air cleaner includes a first housing including an inlet and an opening, a second housing including an outlet and an opening, and a filter element arranged between the opening of the first housing and the opening of the second housing. At least one of the first housing and the second housing includes a sound reducing wall portion. The sound reducing wall portion includes a sound absorbing layer made of an air permeable material, and an inner covering layer, which is fixed to an inner surface of the sound absorbing layer and made of a material having a lower air permeability than that of the sound absorbing layer.

DETAILED DESCRIPTION OF THE PREFERRED EMBODIMENTS

One embodiment will now be described with reference to FIGS. 1 to 3.

Figure 1:
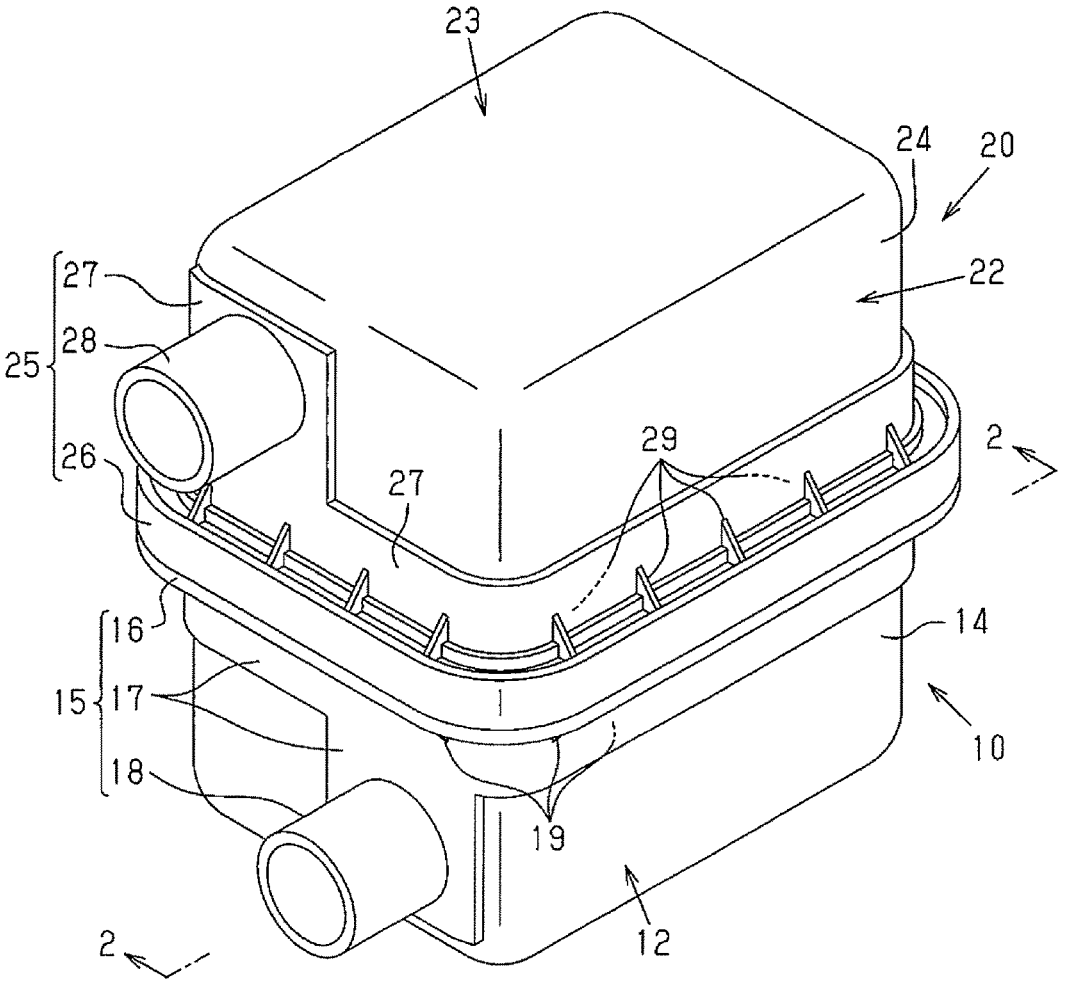
FIG. 1 is a perspective view showing the structure of an entire air cleaner for an internal combustion engine according to one embodiment.
Figure 2:
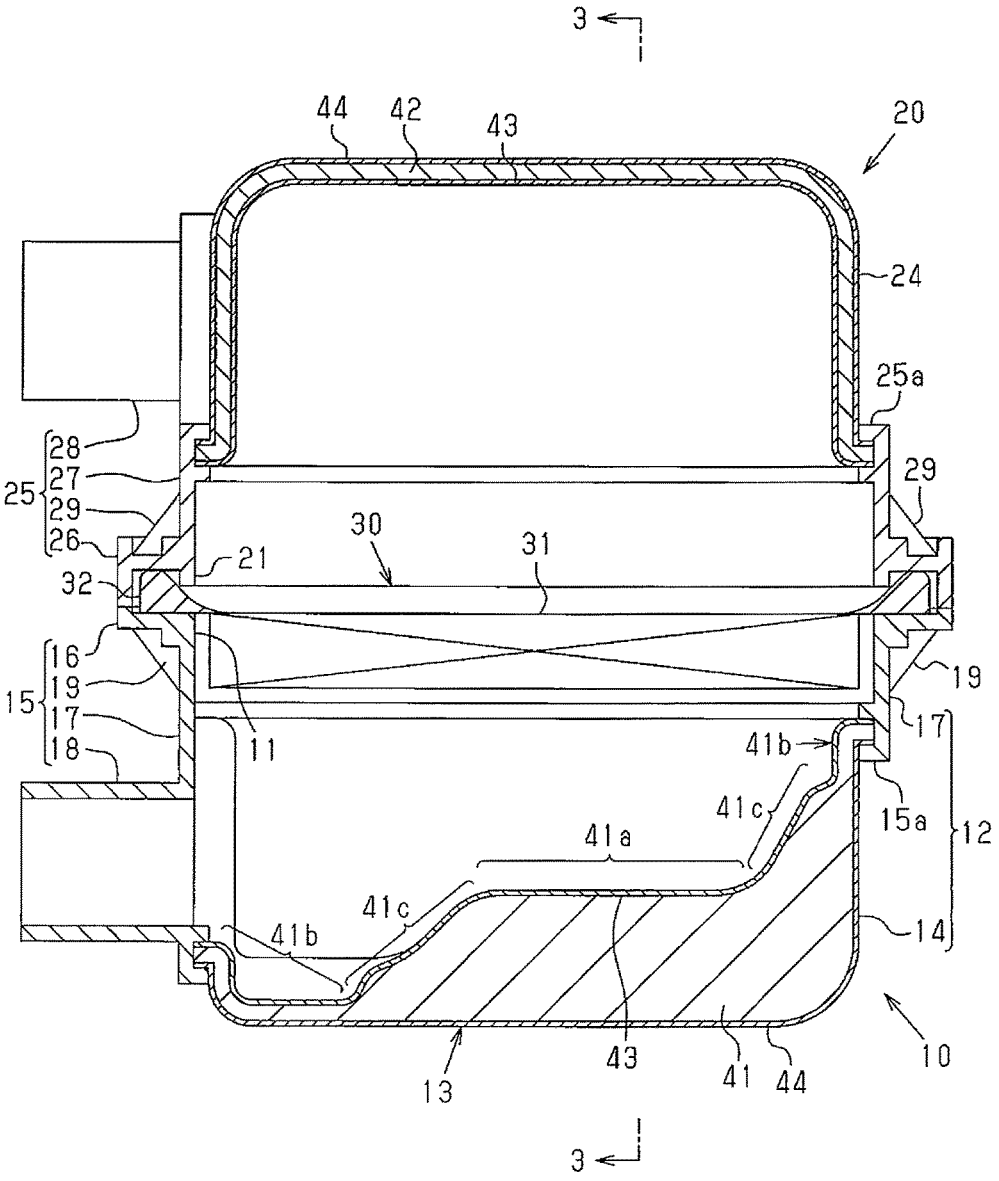
FIG. 2 is a cross-sectional view taken along line 2-2 of FIG. 1.
Figure 3:
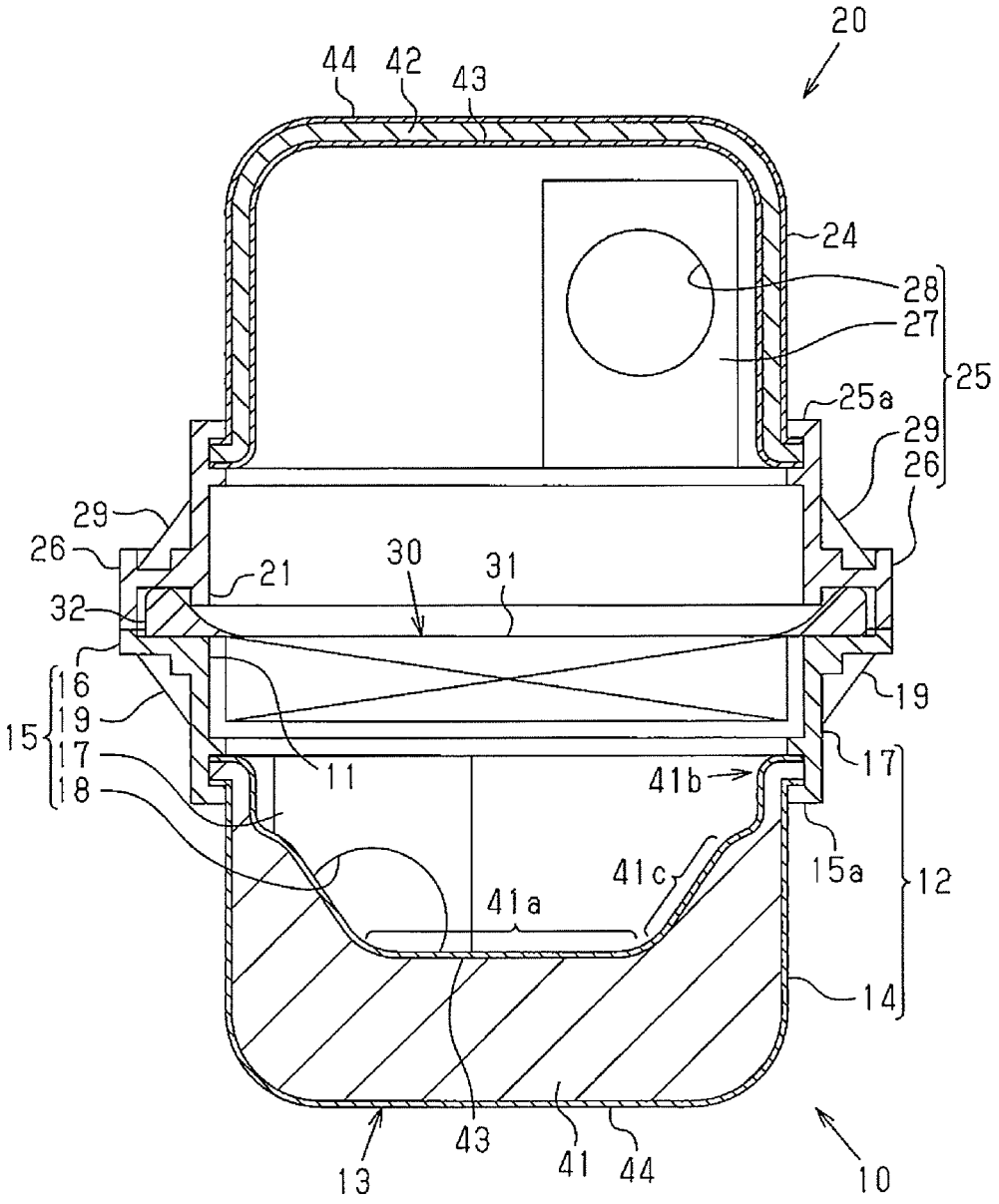
FIG. 3 is a cross-sectional view taken along line 3-3 of FIG. 2.

An air cleaner shown in FIGS. 1 to 3 is arranged in an intake passage of a vehicle-mounted internal combustion engine and includes a first housing 10 having a cylindrical inlet 18 and a second housing 20 having a cylindrical outlet 28.

As shown in FIGS. 2 and 3, the first housing 10 includes a peripheral wall 12, which surrounds an upper opening 11, and a bottom wall 13. An outward extending flange 16 is provided around the entire periphery of the upper opening 11. The inlet 18 protrudes from the outer surface of the peripheral wall 12.

The second housing 20 has a peripheral wall 22, which surrounds a lower opening 21, and a top wall 23. An outward extending flange 26 is provided around the entire periphery of the lower opening 21. The outlet 28 protrudes from the outer surface of the peripheral wall 22.

A filter element 30 is arranged between the upper opening 11 of the first housing 10 and the lower opening 21 of the second housing 20. The filter element 30 has a filtration portion 31 and a loop-shaped sealing portion 32. The filtration portion 31 is formed by pleating a filtering medium sheet of, for example, filter paper or nonwoven fabric, and the sealing portion 32 is provided at the outer periphery of the filtration portion 31.

The sealing portion 32 is held by the flange 16 of the first housing 10 and the flange 26 of the second housing 20 to seal the gap between the first housing 10 and the second housing 20.

The structure of the first housing 10 will now be described.

As shown in FIGS. 1 to 3, the first housing 10 has a molded plastic portion 15, which is made of a hard plastic, and a sound reducing wall portion 14, which is made of, for example, a nonwoven fabric sheet. The molded plastic portion 15 is integrally formed with the sound reducing wall portion 14 by insert molding.

The molded plastic portion 15 is a component that constitutes the flange 16, the inlet 18, and part of the peripheral wall 12. The molded plastic portion 15 includes a plastic wall portion 17 and a plurality of ribs 19. The plastic wall portion 17 is located between the flange 16 and the inlet 18. The ribs 19 are spaced apart in the direction along the periphery and protrude from the outer surface of the plastic wall portion 17 and the flange 16.

The sound reducing wall portion 14 is constituted by the bottom wall 13 and the peripheral wall 12 except the molded plastic portion 15.

The cross-sectional structure of the sound reducing wall portion 14 will now be described.

As shown in FIGS. 2 and 3, the sound reducing wall portion 14 includes a sound absorbing layer 41, an inner covering layer 43, and an outer covering layer 44. The sound absorbing layer 41 is made of a nonwoven fabric sheet. The inner covering layer 43 is made of a nonwoven fabric sheet having a lower air permeability than that of the sound absorbing layer 41 and is fixed to the inner surface of the sound absorbing layer 41 with adhesive. The outer covering layer 44 is made of a non-air permeable film and is fixed to the outer surface of the sound absorbing layer 41 with adhesive.

<Sound Absorbing Layer 41>

The nonwoven fabric sheet constituting the sound absorbing layer 41 is composed of known sheath-core type conjugate fiber including cores containing, for example, polyethylene terephthalate (PET) and sheaths containing modified PET having a melting point lower than that of the PET fiber of the cores (neither is illustrated).

The basis weight of the nonwoven fabric sheet constituting the sound absorbing layer 41 is preferably 300 g/m$^2$ to 1500 g/m$^2$.

The sound absorbing layer 41, which is shown in FIGS. 2 and 3, is formed by hot pressing a nonwoven fabric sheet having a thickness of, for example, 30 mm to 100 mm. The sound absorbing layer 41 has a thick portion 41*a*, a thin portion 41*b*, and a gradual change portion 41*c* located between the thick portion 41*a* and the thin portion 41*b*. The thin portion 41*b* is formed by compressing the nonwoven fabric by a greater amount than the thick portion 41*a*. The gradual change portion 41*c* is formed such that the thickness gradually decreases from the thick portion 41*a* to the thin portion 41*b*. The thick portion 41*a* and relatively thick sections of the gradual change portion 41*c* absorb and reduce intake noise.

The thick portion 41*a* is provided in a range on the bottom wall 13 of the first housing 10 that is farther from the inlet 18 with respect to the center (on the right side in FIG. 2). The thickness of the thick portion 41*a* is preferably 5 mm to 50 mm.

The thin portion 41*b* is provided over the entire periphery of the sound reducing wall portion 14. The periphery of the sound reducing wall portion 14 is held by a holding portion 15*a* of the molded plastic portion 15 from the opposite sides in the thickness direction. This integrates the sound reducing wall portion 14 and the molded plastic portion 15. The thickness of the thin portion 41*b* is preferably 1 mm to 3 mm.

<Inner Covering Layer 43>

The nonwoven fabric sheet constituting the inner covering layer 43 is composed of, for example, main fibers that contain PET and binder fibers that contain polypropylene (PP) and bind the main fibers together.

The air permeability of the inner covering layer 43 (measured in accordance with JIS L 1096, A-Method (Frazier Method)) is preferably 3 cm$^3$/cm$^2$·s or higher, and more preferably 5 cm$^3$/cm$^2$·s or higher.

The air permeability of the inner covering layer 43 is preferably 50 cm$^3$/cm$^2$·s or lower, and more preferably 20 cm$^3$/cm$^2$·s or lower.

In the present embodiment, the air permeability of the inner covering layer 43 is 5 cm$^3$/cm$^2$·s to 20 cm$^3$/cm$^2$·s.

The thickness of the inner covering layer 43 is preferably 1 μm to 500 μm. The thickness of the inner covering layer 43 of the present embodiment is, for example, 10 μm to 15 μm.

<Outer Covering Layer 44>

The outer covering layer 44 is a waterproof film containing PP, for example. The thickness of the outer covering layer 44 is preferably 10 μm to 500 μm.

The structure of the second housing 20 will now be described.

As shown in FIGS. 1 to 3, the second housing 20 has a molded plastic portion 25, which is made of a hard plastic, and a compressed wall portion 24, which is made of, for example, a compressed nonwoven fabric sheet. The molded plastic portion 25 is integrally formed with the compressed wall portion 24 by insert molding.

The molded plastic portion 25 is a component that constitutes the flange 26, the outlet 28, and part of the peripheral wall 22. The molded plastic portion 25 includes a plastic wall portion 27 and a plurality of ribs 29. The plastic wall portion 27 is located between the flange 26 and the outlet 28. The ribs 29 are spaced apart in the direction along the periphery and protrude from the outer surface of the plastic wall portion 27 and the flange 26.

The compressed wall portion 24 is constituted by the top wall 23 and the peripheral wall 22 except the molded plastic portion 25.

The cross-sectional structure of the compressed wall portion 24 will now be described.

As shown in FIGS. 2 and 3, the compressed wall portion 24 includes a compressed layer 42, an inner covering layer 43, and an outer covering layer 44. The compressed layer 42 is made of the same nonwoven fabric sheet as the sound absorbing layer 41 described above. The inner covering layer 43 is fixed to the inner surface of the compressed layer 42 with adhesive. The outer covering layer 44 is fixed to the outer surface of the compressed layer 42 with adhesive. The inner covering layer 43 and the outer covering layer 44 are identical to the inner covering layer 43 and the outer covering layer 44 constituting the sound reducing wall portion 14.

The compressed layer 42 is formed by hot pressing a nonwoven fabric sheet having a thickness of, for example, 30 mm to 100 mm. The thickness of the compressed layer 42 is preferably 1 mm to 3 mm.

The periphery of the compressed wall portion 24 is held by a holding portion 25*a* of the molded plastic portion 25 from the opposite sides in the thickness direction. This integrates the compressed wall portion 24 and the molded plastic portion 25.

Operation of the present embodiment will now be described.

Figure 4:
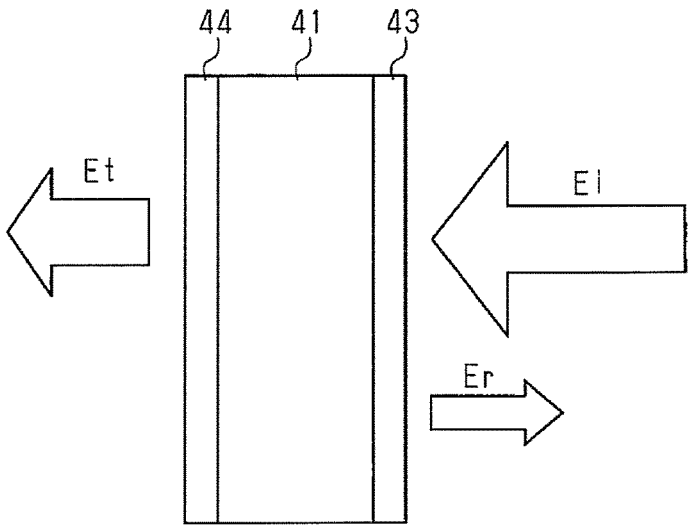
FIG. 4 is an explanatory cross-sectional view showing operation of a sound reducing wall portion.

As shown in FIG. 4, in the first housing 10, the inner covering layer 43, which is made of a material having a lower air permeability than that of the sound absorbing layer 41, is fixed to the inner surface of the sound absorbing layer 41 with adhesive. Therefore, when the intake noise Ei enters the inner covering layer 43, the inner covering layer 43 is caused to resonate by the component of the noise Ei that has the same frequency as the resonance frequency F of the inner covering layer 43. Er denotes reflection noise reflected by the inner covering layer 43. Et denotes transmission noise that passes through the sound reducing wall portion 14.

Figure 5:
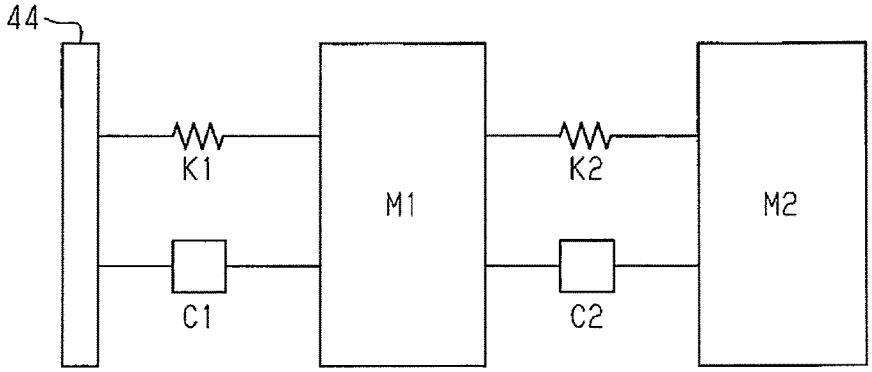
FIG. 5 is an explanatory diagram showing a spring-mass model of operation of the sound reducing wall portion.

FIG. 5 shows a spring-mass model of the sound reducing wall portion 14.

K1 denotes the spring constant (N/mm) of the sound absorbing layer 41, and M1 denotes the mass (kg) of the sound absorbing layer 41. K2 denotes the spring constant (N/mm) between the sound absorbing layer 41 and the inner covering layer 43, M2 denotes the sum of the mass (kg) of the inner covering layer 43 and the mass (kg) of the air blocked by the inner covering layer 43. M2 depends on the acoustic transmission coefficient T2 of the inner covering layer 43. That is, the smaller the air permeability of the inner covering layer 43, the greater the value of M2 becomes. C1 and C2 each denote an attenuation coefficient.

Figure 6:
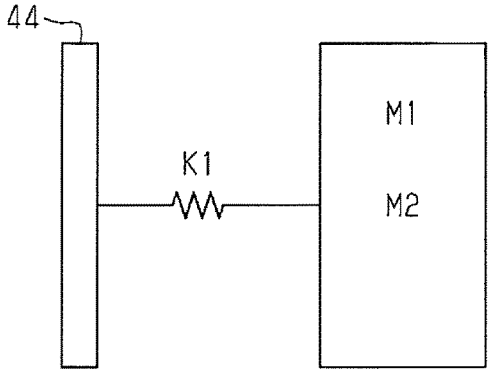
FIG. 6 is an explanatory diagram showing an approximate model of a spring-mass model of operation of the sound reducing wall portion.

The values of C1, C2, and K2 are so small that the contribution to the resonance frequency F of the inner covering layer 43 is negligible. For this reason, the spring-mass model shown in FIG. 5 can be approximated by the approximate model shown in FIG. 6. Therefore, the resonance frequency F (Hz) of the inner covering layer 43 can be approximated by the following expression 1.

$$F = \frac{1}{2\pi}\sqrt{\frac{K1}{M1 + M2}} \quad \text{(Expression 1)}$$

As is apparent from the expression 1, the resonance frequency F of the inner covering layer 43 increases as K1 increases and decreases as M1 and M2 increase. Also, as described above, the smaller the air permeability of the inner covering layer 43, the greater the value of M2 becomes. Therefore, the resonance frequency F of the inner covering layer 43 decreases as the air permeability of the inner covering layer 43 decreases.

As described above, the inner covering layer 43 is made of a material having a lower air permeability than that of the sound absorbing layer 41. Thus, compared with the configuration in which the inner covering layer 43 is not provided, a component of a lower frequency range (hereinafter, referred to as a low frequency component) causes the inner covering layer 43 to resonate. The vibration caused by the resonance vibrates the fibers in the sound absorbing layer 41, generating frictional heat among the fibers. In this manner, the energy of the vibration is consumed by being converted into frictional heat. This reduces components of the low frequency range of the reflection noise Er reflected by the inner covering layer 43.

The air cleaner for an internal combustion engine according to the above described embodiment has the following advantages.

(1) The first housing 10 includes the sound reducing wall portion 14. The sound reducing wall portion 14 has the sound absorbing layer 41, which is made of nonwoven fabric, and the inner covering layer 43, which is fixed to the inner surface of the sound absorbing layer 41 and made of a material having a lower air permeability than that of the sound absorbing layer 41.

This configuration operates in the above described manner and thus effectively reduces components of the low frequency range of intake noise.

(2) The air permeability of the inner covering layer 43 is 5 $cm^3/cm^2 \cdot s$ to 20 $cm^3/cm^2 \cdot s$.

If the inner covering layer 43 is made of a non-air permeable material, the value of M2 is further increased, and the resonance frequency F of the inner covering layer 43 is further reduced. This is thought to reduce components of lower frequencies of the intake noise.

However, in this case, since the intake noise scarcely reaches the sound absorbing layer 41, the sound absorbing effect by the sound absorbing layer 41 is unlikely to be exerted. This has the drawback that components of a high frequency range higher than 1 kHz in the intake noise cannot be readily reduced.

In this respect, according to the above configuration, the air permeability of the inner covering layer 43 is in the range from 5 $cm^3/cm^2 \cdot s$ to 20 $cm^3/cm^2 \cdot s$. This prevents the drawback from being caused due to the air permeability of the inner covering layer 43 being set to be excessively low. Therefore, components of a frequency range higher than 1 kHz in the intake noise are reduced by the sound absorbing effect by the sound absorbing layer 41. Further, component of a low frequency range up to 1 kHz in the intake noise is reduced by using the resonance of the inner covering layer 43. Accordingly, components of a wider frequency range in the intake noise are reduced.

(3) The inner covering layer 43 is fixed to the sound absorbing layer 41 with adhesive. Thus, the inner covering layer 43 is easily and firmly fixed to the sound absorbing layer 41. This adequately prevents the inner covering layer 43 from peeling off the sound absorbing layer 41 due to the intake negative pressure generated during operation of the internal combustion engine.

(4) The inner surface of the first housing 10 is formed by the inner covering layer 43 having an air permeability lower than that of the sound absorbing layer 41.

This increases the smoothness of the inner surface of the first housing 10 as compared with a configuration in which the inner covering layer 43 is not provided, that is, a configuration in which the sound absorbing layer 41 is exposed to the interior of the first housing 10. Therefore, air flows smoothly along the inner surface of the first housing 10, and the airflow resistance is reduced.

(5) The first housing 10 includes the molded plastic portion 15, which constitutes the flange 16, the inlet 18, and the plastic wall portion 17 located between the flange 16 and the inlet 18. The molded plastic portion 15 is integrally formed with the sound reducing wall portion 14.

The flange 16 is a portion against which the sealing portion 32 of the filter element 30 is pressed, and is thus required to have a high stiffness. In addition, the inlet 18 is a portion to which the inlet duct (not shown) is connected, and is thus required to have a high stiffness. In this regard, the above described configuration adequately prevents the first housing 10 from having an insufficient stiffness.

(6) The sound absorbing layer 41 has the thick portion 41*a* and the thin portion 41*b*, which is formed by compressing nonwoven fabric by a greater amount than the thick portion 41*a*, and the thin portion 41*b* of the sound reducing wall portion 14 is coupled to the molded plastic portion 15.

This configuration increases the stiffness of the part of the sound reducing wall portion 14 that is coupled to the molded plastic portion 15 with the thin portion 41*b*, and allows the sound absorbing layer 41 to exert the sound absorbing effect using the thick portion 41*a*.

(7) The gradual change portion 41*c* is provided between the thick portion 41*a* and the thin portion 41*b* such that the thickness gradually decreases from the thick portion 41*a* to the thin portion 41*b*.

With this configuration, a step is unlikely to be formed at which the thickness of the sound absorbing layer 41 abruptly changes between the thick portion 41*a* and the thin portion 41*b*. This allows air to flow smoothly inside the first housing 10 and reduces the airflow resistance.

(8) Only the first housing 10 has the sound reducing wall portion 14.

The thick portion 41*a* of the sound reducing wall portion 14 has a lower stiffness and a lower negative pressure resistance than the thin portion 41*b*. Since the first housing 10 is located on the intake upstream side of the filter element 30, the negative pressure acting on the first housing 10 is less than the negative pressure acting on the second housing 20.

In this respect, according to the above described configuration, the sound reducing wall portion 14 is provided only in the first housing 10, but not in the second housing 20. Therefore, it is possible to ensure the negative pressure resistance of the first housing 10 and the second housing 20 and reduction of the intake noise by the sound reducing wall portion 14 at the same time.

(9) The non-air permeable outer covering layer 44 is provided on the outside of the sound absorbing layer 41. Therefore, it is possible to reduce the transmission noise Et, which passes through the sound reducing wall portion 14. Further, the outer covering layer 44, which is waterproof, prevents entry of water into the interior of the air cleaner through the sound absorbing layer 41.

(10) Part of the first housing 10 is formed by the sound reducing wall portion 14, which has the sound absorbing layer 41 and the inner covering layer 43, both of which are made of nonwoven fabric. Part of the second housing 20 is formed by the compressed wall portion 24, which has the compressed layer 42 and the inner covering layer 43, both of which are made of nonwoven fabric.

With this configuration, it is easier to reduce the weight of the first housing 10 and the second housing 20, and further reduce the weight of the air cleaner, as compared with a configuration in which the first housing 10 and the second housing 20 are formed entirely of a hard plastic.

(11) The molded plastic portions 15, 25 are provided with the holding portions 15*a*, 25*a* for holding the thin portion 41*b* of the sound reducing wall portion 14 and the compressed layer 42 of the compressed wall portion 24, respectively.

With this configuration, when the molded plastic portions 15, 25 are insert-molded in the sound reducing wall portion 14 and the compressed wall portion 24, the plastic forming the holding portions 15*a*, 25*a* permeates into a wider range of the thin portion 41*b* of the sound reducing wall portion 14 and the compressed layer 42 of the compressed wall portion 24. This firmly join the thin portion 41*b* of the sound reducing wall portion 14 and the compressed wall portion 24 to the molded plastic portions 15, 25 by the anchor effect.

<Modifications>

The above described embodiment may be modified as follows.

Figure 7:
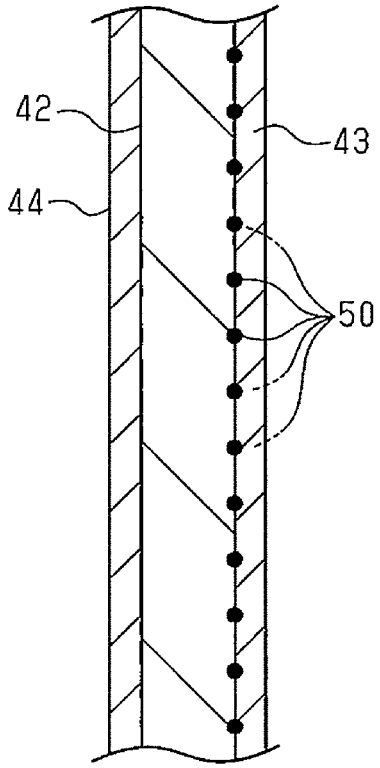
FIG. 7 is a cross-sectional view of a compressed wall portion according to a modification.

As shown in FIG. 7, adsorbent 50 for adsorbing fuel vapor may be provided between the inner covering layer 43 and the compressed layer 42 of the compressed wall portion 24. Further, the adsorbent 50 may be provided between the inner covering layer 43 and the sound absorbing layer 41 of the sound reducing wall portion 14. In this case, fuel vapor flowing into the air cleaner through the intake passage during engine stop is adsorbed by the adsorbent 50. Therefore, unlike a configuration in which an adsorption sheet is provided in the middle of the intake passage, the airflow resistance is not increased.

For example, the outer covering layer 44 may be made of an air permeable material such as a nonwoven fabric sheet. In this case, the outer covering layer 44 simply needs to be made of a material having a lower air permeability than the sound absorbing layer 41. The outer covering layer (the outer layer) may be omitted.

In addition to or in lieu of providing the first housing 10 with a sound reducing wall portion, it is possible to provide the second housing 20 with a sound reducing wall portion. Also, the entire second housing 20 can be formed by a molded plastic portion.

The gradual change portion 41*c* of the sound absorbing layer 41 may be omitted.

The entire first housing 10 can also be formed by the sound reducing wall portion 14. That is, the molded plastic portion 15 may be omitted.

For example, the sound absorbing layer 41 may be made of foamed polyurethane.

The air permeability of the inner covering layer 43 may be made less than 3 $cm^3/cm^2 \cdot s$. Also, the air permeability of the inner covering layer 43 may be made higher than 50 $cm^3/cm^2 \cdot s$.

The invention claimed is:

1. An air cleaner for an internal combustion engine, comprising:

a first housing including an inlet and an opening;

a second housing including an outlet and an opening; and a filter element arranged between the opening of the first housing and the opening of the second housing, wherein at least one of the first housing and the second housing includes a sound reducing wall portion, and the sound reducing wall portion includes a sound absorbing layer made of an air permeable material, and an inner covering layer, which is fixed to an inner surface of the sound absorbing layer and made of a material having a lower air permeability than that of the sound absorbing layer.

2. The air cleaner for an internal combustion engine according to claim 1, wherein an air permeability of the inner covering layer is 3 $cm^3/cm^2$-s to 50 $cm^3/cm^2$-s.

3. The air cleaner for an internal combustion engine according to claim 1, wherein the air permeable material is a nonwoven fabric.

4. The air cleaner for an internal combustion engine according to claim 1, wherein of the first housing and the second housing, the housing including the sound reducing wall portion includes a molded plastic portion, which constitutes at least one of the inlet, the outlet, and a flange that forms a periphery of the opening, and the molded plastic portion is integrally formed with the sound reducing wall portion.

5. The air cleaner for an internal combustion engine according to claim 4, wherein the sound absorbing layer includes a thick portion and a thin portion that is formed by compressing the air permeable material by a greater amount than the thick portion, and the thin portion of the sound reducing wall portion is coupled to the molded plastic portion.

6. The air cleaner for an internal combustion engine according to claim 5, wherein a gradual change portion is provided between the thick portion and the thin portion, and the gradual change portion is formed such that the thickness gradually decreases from the thick portion to the thin portion.

7. The air cleaner for an internal combustion engine according to claim 5, wherein only the first housing includes the sound reducing wall portion.

8. The air cleaner for an internal combustion engine according to claim 1, wherein an outer layer is provided on an outer side of the sound absorbing layer, and the outer layer is made of a material having a lower air permeability than that of the sound absorbing layer.

9. The air cleaner for an internal combustion engine according to claim 1, wherein the inner covering layer has air permeability, and an adsorbent that adsorbs fuel vapor is provided between the inner covering layer and the sound absorbing layer.

* * * * *